US006126012A

United States Patent [19]

Roegner

[11] Patent Number: 6,126,012

[45] Date of Patent: Oct. 3, 2000

[54] BINGO BAG CARRYING CASE

[76] Inventor: DeAnna Roegner, 774 Mays Blvd. #10-405, Incline Village, Nev. 89451

[21] Appl. No.: 09/287,457

[22] Filed: Apr. 7, 1999

[51] Int. Cl.[7] ..... B65D 69/00; A45C 3/10; A45C 13/00

[52] U.S. Cl. ..... 206/579; 150/112; 190/102; 190/109; 190/112; 206/315.1

[58] Field of Search ..... 206/579, 525, 206/315.1; 150/106, 112, 118; 190/102, 109–111, 112

[56] References Cited

U.S. PATENT DOCUMENTS

| | | | |
|---|---|---|---|
| D. 276,954 | 1/1985 | Kruger . | |
| D. 342,638 | 12/1993 | Harland | D6/601 |
| D. 345,651 | 4/1994 | Copp . | |
| D. 355,301 | 2/1995 | Tumulty . | |
| D. 358,483 | 5/1995 | Cross et al. . | |
| D. 379,267 | 5/1997 | Roegner . | |
| 2,131,583 | 9/1938 | Crotty et al. | 190/111 X |
| 2,299,673 | 10/1942 | Zolkind | 190/102 X |
| 3,871,519 | 3/1975 | Groomes | 206/315.1 X |
| 4,106,598 | 8/1978 | Davis | 190/111 |
| 4,301,898 | 11/1981 | Plough et al. | 190/102 |
| 4,506,769 | 3/1985 | Franco et al. . | |
| 4,620,579 | 11/1986 | Lowe et al. | 190/110 X |
| 4,716,947 | 1/1988 | Haddock | 150/106 |
| 4,739,809 | 4/1988 | Adams . | |
| 4,925,021 | 5/1990 | Pulichino, Jr. | 190/112 X |
| 4,960,204 | 10/1990 | Young et al. . | |
| 4,977,941 | 12/1990 | Henderson | 150/112 |
| 5,105,920 | 4/1992 | Grebenstein | 190/111 X |
| 5,160,001 | 11/1992 | Marceau . | |
| 5,190,377 | 3/1993 | Kelly | 150/112 X |
| 5,295,565 | 3/1994 | Latshaw | 190/102 X |
| 5,423,404 | 6/1995 | Shaw | 190/102 |
| 5,678,666 | 10/1997 | Shyr et al. | 190/102 |
| 5,813,445 | 9/1998 | Christman . | |
| 5,845,780 | 12/1998 | Allen | 206/579 |
| 5,918,711 | 7/1999 | Godshaw | 190/112 X |
| 6,000,509 | 12/1999 | Chisholm | 190/112 X |

FOREIGN PATENT DOCUMENTS

| | | |
|---|---|---|
| 1287867 | 4/1961 | France . |
| 97 15 908 U | 4/1988 | Germany . |

*Primary Examiner*—Bryon P. Gehman
*Attorney, Agent, or Firm*—Baker & Maxham

[57] ABSTRACT

A bingo bag carrying case comprising a primary shell of weatherproof pliable material, the shell formed of at least two half shells connected together for hinging along a common side and forming at least two receptacles, each half shell formed of a rectangular back panel with a bottom panel, a top panel and two end panels secured along the periphery of the back panel forming the at least two receptacles, a multipocket panel assembly secured to the external facing side panel of one of the half shells and including a pleated or zig-zag folded panel forming a plurality of pockets having spaces therebetween, and a foldable closure panel that is secured along the hinging edge along the common side of one of the external half shells and folds over the plurality of pockets. The lower closure panel has multiple pockets for storing assorted items. When the closure panel is closed, an upper closure flap panel can fold over top of the lower closure panel to secure the lower closure panel in place using a fastener member. The carrying case is waterproofed for all weather conditions. The case includes, in kit form, a seat cushion and small blanket that are both sized to be carried in one of the half shell receptacles.

22 Claims, 5 Drawing Sheets

BINGO BAG CARRYING CASE

BACKGROUND OF THE INVENTION

The present invention relates to a carrying case and, more particularly to a bingo bag carrying case having several pocket assemblies, compartments and retaining members for organizing and storing various bingo paraphernalia.

The game of bingo is enjoyed by individuals of all ages and is widely played at various establishments, such as churches, clubs, or the like. People often carry many items that are often placed loosely in a carrying bag when going to these bingo establishments. Playing bingo requires the use of bingo cards, bingo markers, magnetic wands, daubers (special large markers in various colors which are utilized in playing paper bingo games), pencils, tablets, or the like. In addition, bingo players also carry to the bingo game assorted items such as eye glasses, food, candy, beverages, umbrella, keys, purse, wallet, good luck charms. It is cumbersome to carry several bags containing all of these items, and is difficult to easily locate a particular item mixed in with all of the other bingo accessory. Additionally, often a bingo player takes a small blanket and seat cushion for personal comfort that are carried in a separate carrying bag that frequently become misplaced or forgotten. U.S. design Pat. Nos. Des. 276,954 and Des. 342,638 show an integrated seat cushion forming part of two versions of a bingo bag, but do not show the seat cushion as a separate item configured to be carried in a carrying case designed for such items.

There are several kinds of bingo bags. One such bag is disclosed in U.S. Pat. No. 5,813,445 entitled "Bingo Tote Bag" which includes several interior and exterior compartments in one bag and has a shoulder straps thereby allowing a bingo player to organize and carry bingo supplies and other items in a single tote bag. Another bingo bag includes U.S. Pat. No. 5,190,377 entitled "Bingo Purse" that includes several pockets positioned about an exterior surface of the purse for holding bingo items, such as daubers, glasses, pencils and the like. Other bags for playing bingo include U.S. Pat. No. 4,977,941 entitled "Bingo Bag with Self-Supporting Vertical Wall" and U.S. Pat. No. 4,646,804 entitled "Handbag for Playing Bingo" which both disclose bingo bags having several pockets positioned about an interior surface of the bag for holding various bingo items. However, these prior bags are not not designed for inclement weather and readily provide access to frequently needed items such as dauber pens and the like.

Accordingly it is desirable that there be available an all weather bingo bag carrying case that provides ample storage pockets and retaining members for carrying numerous assorted items in a weatherproof bag when going to play bingo.

There is a need for a weatherproof bingo bag carrying case designed for organizing and storing bingo accessories having both interior and exterior pockets for storing bingo items and receptacles for storing a bingo player's seat cushion and blanket that are often needed when playing bingo. It would be desirable to have a case with multiple pockets for holding these multiple items of different sizes in a secure manner and providing ease of accessibility.

SUMMARY OF THE INVENTION

It is the primary object of the present invention to provide a waterproof bingo bag carrying case with multiple pockets for holding items of different sizes in a secure and readily accessible manner. It is another object of the present invention to provide a bingo bag carrying case with a cushion-padded back panel half shell design forming multiple receptacles with external weatherproofed material configured for holding a seat cushion and blanket.

A bingo bag carrying case comprises a weatherproof primary shell of pliable material, the shell formed of at least two half shells connected together for hinging along a common side and forming at least two receptacles, each half shell formed of a rectangular back panel with a bottom panel, a top panel and two end panels secured along the periphery of the back panel forming at least two receptacles, a multipocket panel assembly secured to the external facing side panel of one of the half shells and including a pleated or zig-zag folded panel forming a plurality of pockets having spaces therebetween, and a foldable closure panel that is secured along the hinging edge along the common side of one of the external half shells and folds over the plurality of pockets. The lower closure panel has multiple pockets for storing assorted items. When the closure panel is in a closed position, an upper closure flap panel can fold over the top of the lower closure panel to secure the lower closure panel in place using a fastener member. The invention can include, in kit form, a seat cushion and a small blanket that are both sized to be carried in one of the half shell receptacles. Another aspect of the present invention is a bingo bag carrying case comprising: a weatherproof shell of pliable material, the shell formed of at least a pair of half shells connected together for hinging along a common side thereby forming at least two receptacles, each of the half shells formed of a rectangular back panel with a bottom panel, a top panel and two end panels secured along the periphery of the back panel; and a multipocket assembly mounted to an external face of one of the half shells having: a foldable closure pocket panel and a front pocket panel, the front pocket panel including a pleated pocket panel section that forms a plurality pockets having an open top being generally the same length and shaped and configured to receive articles; and the foldable closure pocket panel configured to overlap and close the open top of the plurality of pockets for securing articles contained within. The multipocket assembly may further include a foldable flap panel that has a fastener member that secures to a back side of the foldable closure panel with the flap panel thereby securing articles retained by the multipocket assembly when the closure panel is secured.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
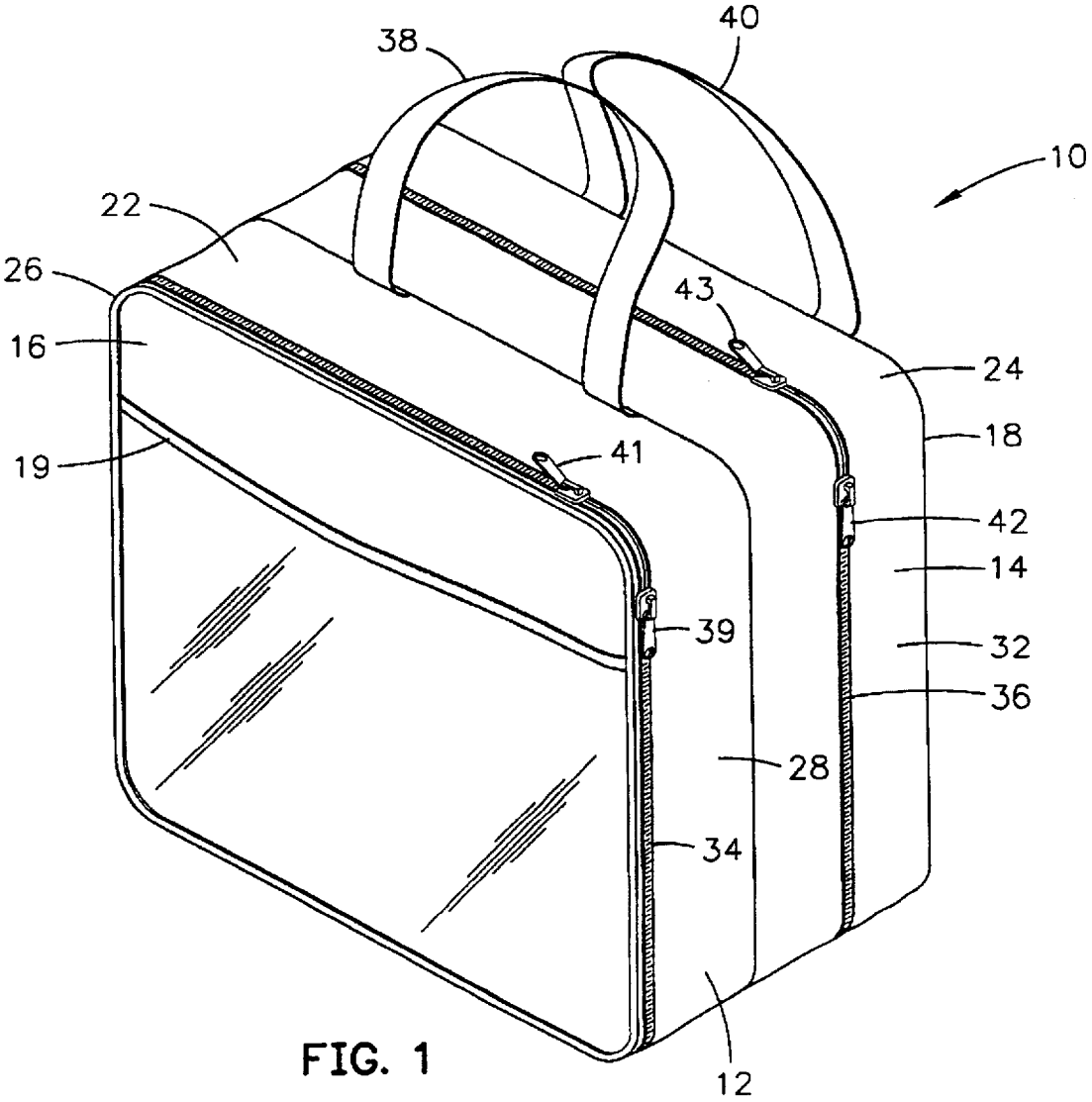
FIG. 1 is a perspective view of an exemplary preferred embodiment of the invention with the bingo bag carrying case closed.

Referring to FIGS. 1 through 4 of the drawing, an exemplary bingo bag hand carried case in accordance with the invention is illustrated and designated generally by the numeral 10. In FIG. 1, the case is preferably constructed of a pliable material such as leather, vinyl, or any of the suitable woven materials now widely used for handbags, purses, suit cases and the like. In a preferred construction, the bingo bag outer shell construction is made of a cotton bingo theme fabric covered with a waterproof clear vinyl material having at least six mil thickness. Each of the back panels forming each of the half shells preferably has quarter inch foam padding as a backing material so that the bingo bag case absorbs shock if accidentally dropped.

The bingo bag carrying case comprises a primary shell formed of a pair of half shells 12 and 14, hinged together along a common side and each half shell forming a receptacle. Each half shell is formed of a generally rectangular back panel 16 and 18 respectively, with a bottom panel which is preferably common to both half shells with a continuous strip forming top panels 22 and 24, end panels 26, 28, and 32 respectively where each of the half shells forms two receptacles. The outer half shells optionally can include a stiffener such as foam, cardboard or the like sandwiched between opposing faces of a multilayered pliable fabric panel to maintain the shape of the case. Alternatively, a seam construction of the outer edges of the case enclosure can provide the desired stiffening of the case without need for a stiffener attached to the outer half shell back panels 16 and 18.

The half shells are secured together along edges of the side and top panels by zipper elements (together) 34 and 36 with sliders 39, 41, 42, and 43 at each side or end of the zipper elements. The term "fastener member" encompass equivalent cooperative members for securing an enclosure or connectable members and include, but are not limited to, a zipper with slider, a snap button, a hook and loop fastener (for example, VELCRO, which is a trademark) and other well known fasteners. The bottom panel flexes and functions as a hinge member for the two half shells and also provides a surface for stable upright case support. One or both of the external outside panels of the case can include an outside open clear pocket 19 for storing magazines, papers and other comparable flat items. Preferably, the pocket 19 is a clear vinyl material to allow viewing and ease of finding items.

Each half shell is provided with an elongated carrying strap 38 and 40, wherein both can be detachably secured together at a mid-point and also be adjustable in length to serve as either a handle or a shoulder strap. The straps 38 and 40, for example, can be secured at one end directly to the side of the half shell and at the other end through a slip loop and to the shell with the opposite end adjustably secured by a buckle (not shown) underneath a hand grip made of a conventional construction forming a slip sleeve over the buckle of one of the straps and opening sleeve secured together in a closed position around the other buckle by suitable means, such as hook and loop fasteners. This enables the straps to be adjusted so that they may serve as a hand carrying strap or shoulder strap as desired.

Figure 2:
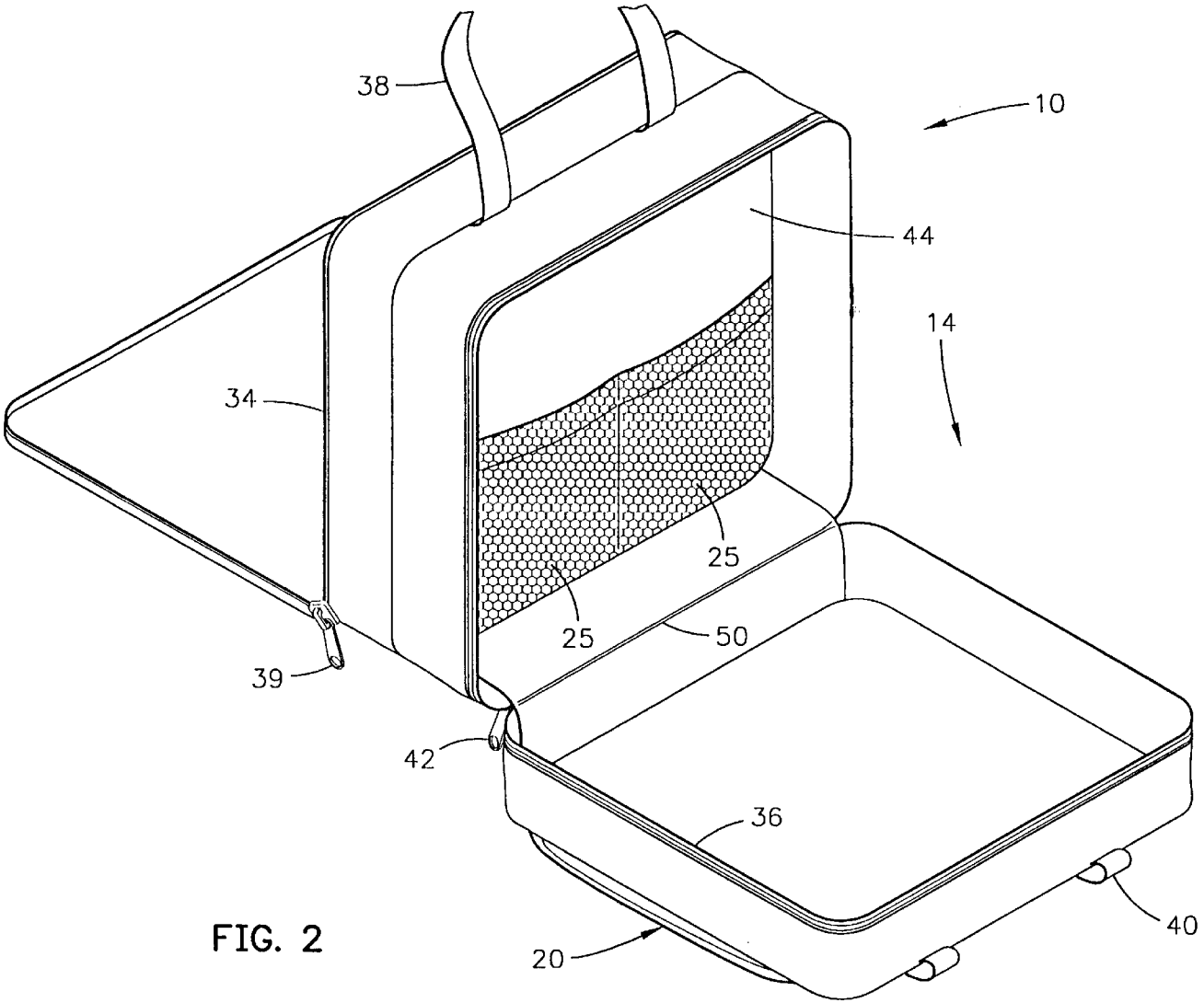
FIG. 2 is a perspective view of the embodiment of FIG. 1 with an obverse side of the bingo bag carrying case as shown in FIG. 1 when open.

Referring to FIG. 2, the overall bingo bag carrying case is provided with a multiple pocket assembly designated generally as the numeral 25, is positioned on the half shell interior back panel 44. The multiple pocket assembly 25 in a preferred design has a common back panel 44 which extends into and preferably forms at least a partial liner in the receptacle of the half shell 12. The interior back panel 44 is preferably made of a transparent material having at least a six-mil thickness made of vinyl. At least one mesh-type pocket assembly 25 is preferably made of a web, netting or mesh-type material with or without a securable foldable flap using a hook and loop fastener and has a bottom transverse edge common with the case hinge 50. As shown, this pocket assembly 25 provides ease of viewing and identifying articles contained within. The back panel 44 may have any number of the pocket assemblies comparable to the assembly 25 for holding any number and kind of small articles (for example a mug retaining pocket).

Figure 3:
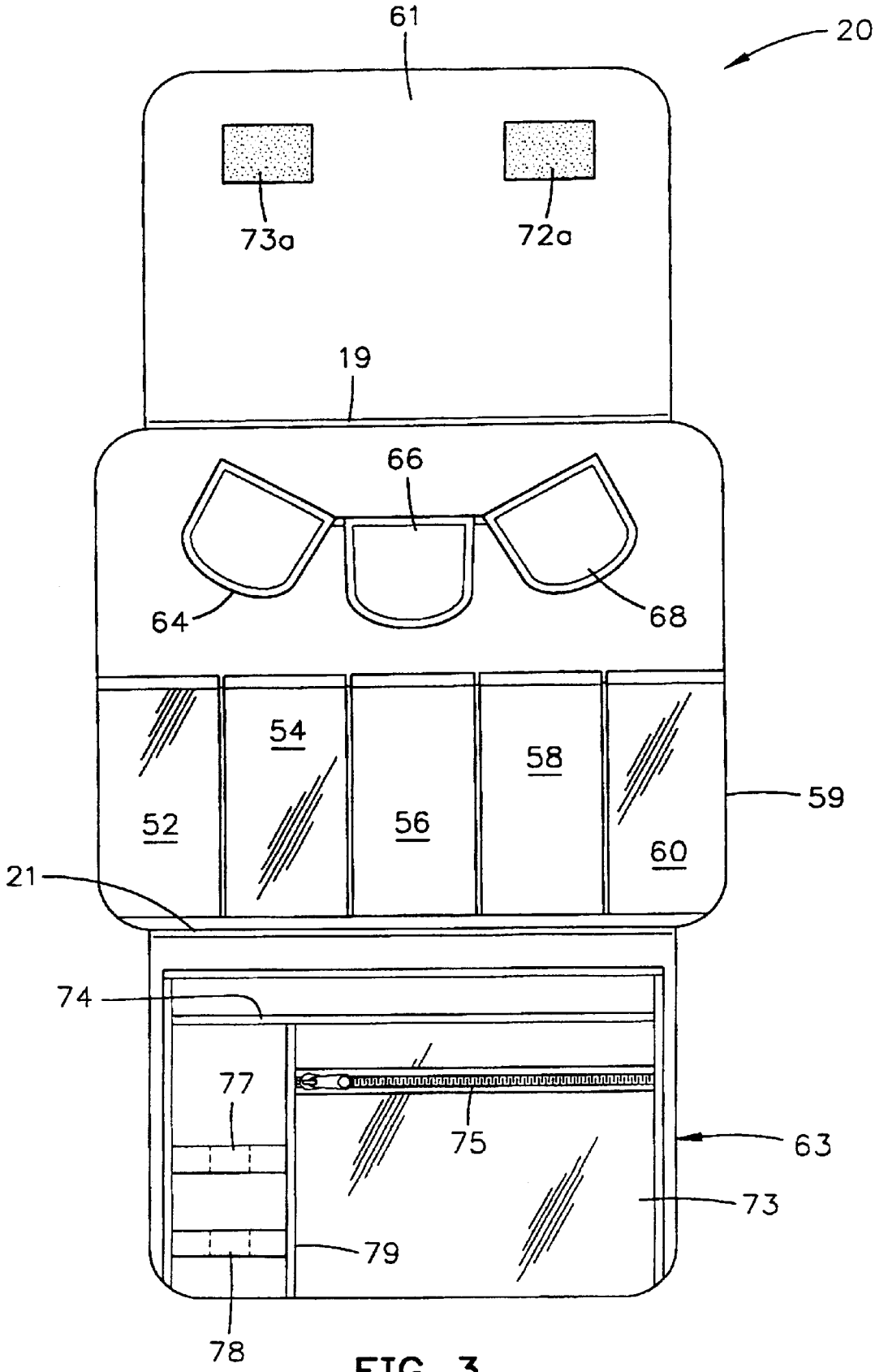
FIG. 3 is a top view of the obverse side of the bingo bag carrying case as shown in FIG. 2 with the half shells closed, and showing a closure pocket panel folded down and exposing a front panel having a pleated open-topped pocket assembly.
Figure 4:
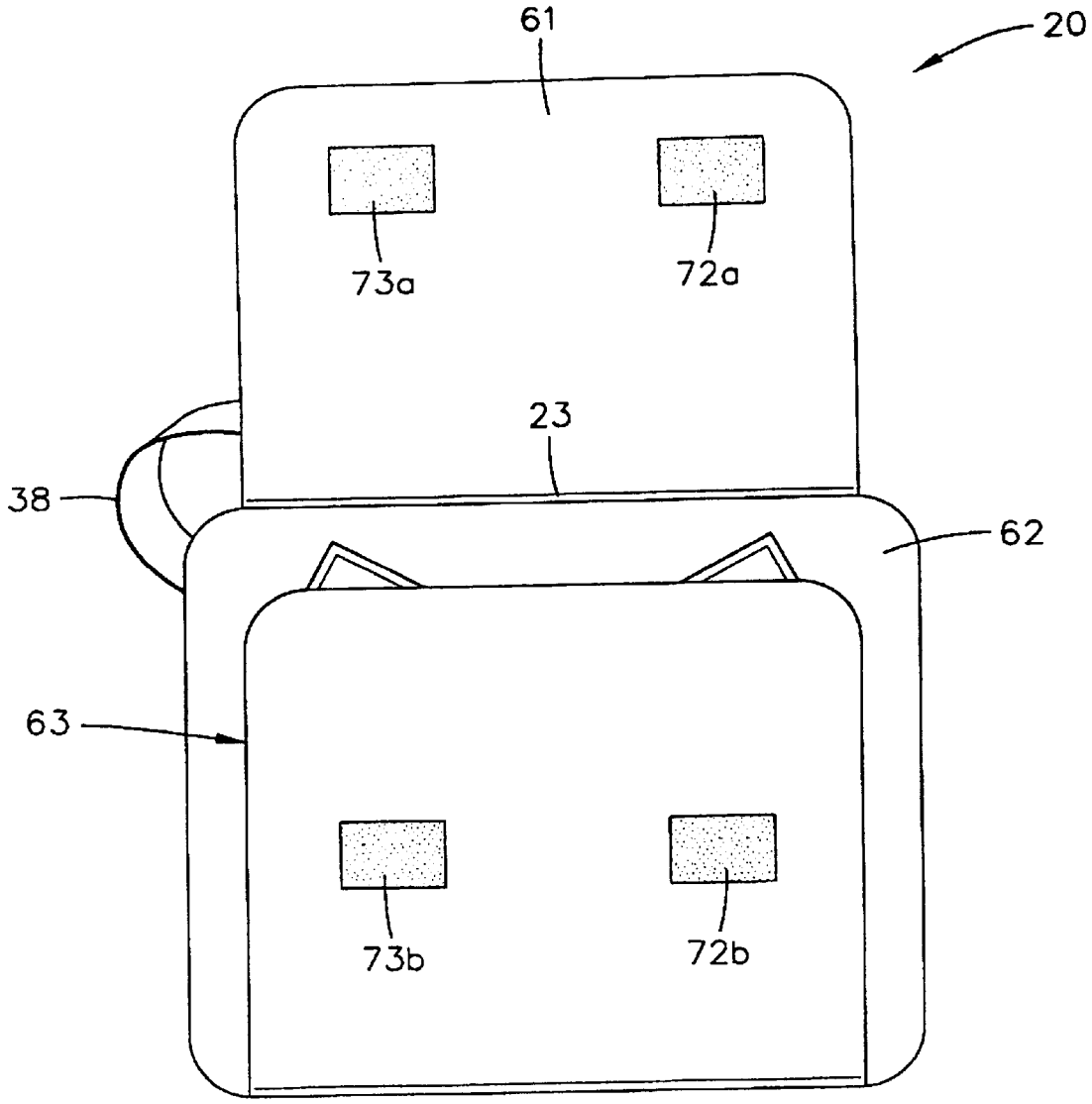
FIG. 4 is a top view of the invention shown in FIG. 3 with the foldable closure pocket panel in a closed configuration where the flap panel is yet open and securable to a mating fastener member on a back side of the foldable closure panel.

Referring to FIGS. 3 and 4, a bifolded multipocket assembly panel is illustrated and generally designated as numeral 20 that comprises disparate pocket assemblies attached to back panels 62 and 63 that folds along a folding line 21 and has a foldable or fold over type securing flap panel 61 for securing the closure pocket panel 62 and front pocket panel 63 in place using a pair of corresponding positioned hook and loop fasteners 72*a*, 73*a*, 72*b*, and 73*b* (FIG. 4) attached to the back side of the panel 63 and the folding flap 61. The bifolded multipocket assembly panel 20 includes, but is not limited to, a zig-zag or pleated pocket assembly having five primary open top pockets, 52, 54, 56, 58, and 60; a good luck charm pocket assembly 64, 66, and 68; and a closure-type pocket 73 and open insertable pocket 74. The pockets 52, 54, 56, 58, and 60 are formed of an overlapping transparent panel with pleated or zig-zag accordion-like folds that form collapsed pockets with folded sides between a front and the back panel 62. The pockets 52, 54, 56, 58, and 60 are formed by a continuous panel that is folded in the pleated or zig-zag position as shown when the pockets are empty. These pockets are formed by the panel which is folded so that with respect to pocket 52, for example, the back panel 62 is secured along an edge 59 to the back pocket panel 62. The excess material of each pocket, 52, 54, 56, 58, and 60 permits expansion of the open top pockets and provides size, shape, and definition to each of the open sided pockets. These pockets are constructed with collapsed or folded sides such that when one of the pockets is partially filled, adjacent spaces between adjacent pockets form an open-sided pocket that is available for the placement of additional articles. However, the pockets are constructed so that they can be completely filled such that no additional space or open sided pockets exist between adjacent pockets. The preferred use of these pockets 52, 54, 56, 58, and 60 are for storage of multiple colored bingo dauber pens. The lucky charm pocket assembly 64, 66, and 68 on back panel 62 are small open pockets that provide ease of storing good luck charms such as small dolls and rabbit feet and the like.

The panel 63 includes a pocket assembly formed of an envelope-type structure with a front panel secured along the side and bottom edge of panel 63 to form at least one pocket with an opening at the top (two pockets 73 and 74 are shown). The pocket assembly is preferably made integral with the panel 63 and may be made out of any suitable fabric or other suitable pliable material, preferably clear vinyl. This pocket assembly may also include a partitioning stitch 79 for organizing contents within multiple pockets to allow ease of construction. The closure-type pocket 73 and open insertable pocket 74 as shown are attached to back panel 63. At a top edge of the closure-type pocket 73, a zipper with slider fastener 75 is shown for closing this pocket. The pockets 73 and 74 are suitable for small, thin items, such as papers, electronic games and the like. The back panel 63 also includes a pair of elongated elastic straps 77 and 78 secured such as by stitching at multiple points along the face of the panel forming the pocket 74 to form a plurality of elastic retaining loops for holding small articles (for example, pens, pencils, bingo bugles, lighters and clothes pins). These multiple loops have limited elasticity to allow ease of securing to or obtaining from the case any small article secured thereto. These multiple loops are selectively secured at locations so as to form fit a particular desired small article.

Figure 5:
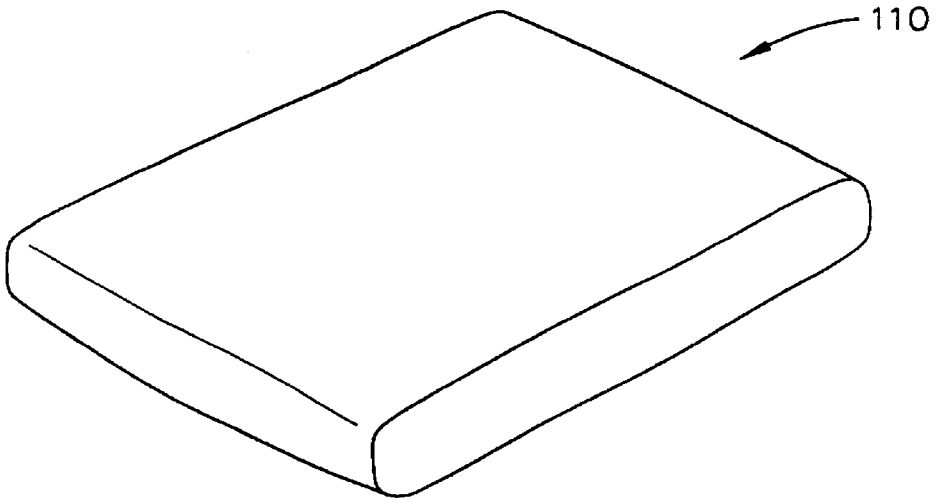
FIG. 5 is a perspective view of a seat cushion configured for storage in one of the receptacles of the bingo bag carrying case.
Figure 6:
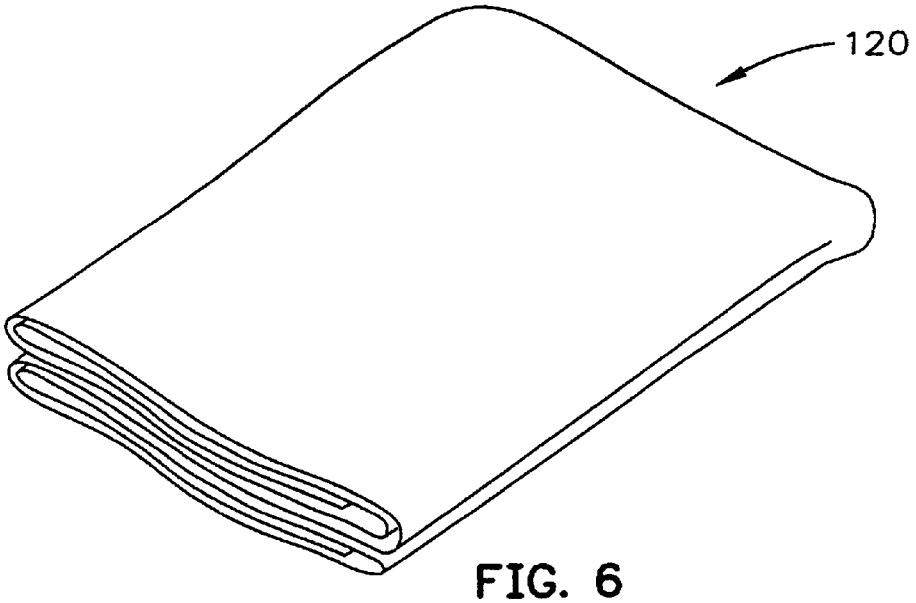
FIG. 6 is a perspective view of a folded blanket configured for storage in one of the receptacles of the bingo bag carrying case.

Referring to FIGS. 5 and 6, a perspective view of a seat cushion 110 and a small blanket 120 respectively are shown. Each of these items is dimensioned to configurably store in one of the receptacles formed by the half shells 12 and 14 of the bingo bag carrying case forming a kit. The blanket 120 can include a closing strap made of a hook and loop fastener 125 for ease of folding and storing within the case. The receptacle formed by half shell 12 shown in FIG. 1 has the zipper fastener 34 attached to the case on the outer perimeter of the half shell 12 which provides ease of storing the seat cushion and blanket which are often forgotten items when going to play bingo.

While I have illustrated and described my invention by means of specific embodiments, it is to be understood that numerous changes and modifications may be made therein without departing from the spirit and the scope of the invention as shown in the appended claims.

I claim:

1. A carrying case comprising:

a weatherproof shell of pliable material, the shell formed of at least a pair of half shells connected together for hinging along a common side thereby forming at least two receptacles, each of the half shells formed of a rectangular back panel with a bottom panel, a top panel and two end panels secured along the periphery of the back panel; and a multipocket assembly mounted to a face of one of the half shells having:

a foldable closure pocket panel and a front pocket panel, the front pocket panel including a pleated pocket panel section that forms a plurality of pleated pockets each having an open top being generally the same length and shaped and configured to receive articles; and a foldable flap panel that has a fastener member that secures to a back side of the foldable closure pocket panel with the flap panel thereby securing articles retained by the multipocket assembly when the foldable closure panel is secured;

wherein the foldable closure pocket panel is configured to overlap and close the open top of the plurality of pockets for securing articles contained within.

2. The carrying case of claim 1, wherein the pleated pockets on the multipocket assembly are formed so that when the pleated pockets are partially filled, space is available between the adjacent pleated pockets for an article.

3. The carrying case of claim 1, wherein the foldable pocket panel has a front panel that includes multiple storage pockets secured along a bottom and side edges of the front panel thereby forming multiple storage spaces.

4. The carrying case of claim 3, wherein the front side of the foldable closure panel has a pair of elongated elastic straps secured at multiple points of the front face so as to form a plurality of loops for retaining articles of specified size and shape.

5. The carrying case of claim 3, wherein the multiple storage pockets comprise at least two storage pockets of an upper and lower storage pocket, the upper storage pocket is an open pocket and the lower storage pocket includes a fastener member.

6. The carrying case of claim 5, wherein the upper and lower storage pockets are transparent.

7. The carrying case of claim 1, wherein the front pocket panel further includes multiple individuated lucky charm pockets for carrying amulets.

8. The carrying case of claim 1 wherein one of the receptacles formed by one of the half shells has at least one mesh pocket secured to a bottom transverse edge common with the carrying case.

9. The carrying case of claim 1 wherein at least one of the external half shells has a pocket formed on its outer half shell for storage of loose items.

10. The carrying case of claim 1 further comprising a seat cushion.

11. The carrying case of claim 1 further comprising a blanket.

12. A carrying case comprising:

a weatherproof shell of pliable material, the shell formed of at least a pair of half shells connected together for hinging along a common side thereby forming at least two receptacles, each of the half shells formed of a rectangular back panel with a bottom panel, a top panel and two end panels secured along the periphery of the back panel; and a multipocket assembly mounted to a face of one of the half shells having:

a foldable closure pocket panel and a front pocket panel, the front pocket panel including a pleated pocket panel section that forms a plurality of pockets, each having an open top being generally the same length and shaped and configured to receive articles;

the foldable closure pocket panel configured to overlap and close the open top of the plurality of pockets for securing articles contained within;

a flap panel foldable over the closure pocket panel and having a fastener member that secures to a back of the foldable closure pocket panel, the flap panel thereby securing articles retained by the multipocket assembly when the closure panel is secured; and a seat cushion configurably dimensioned for storage in one of the receptacles.

13. The carrying case according to claim 12, further including a blanket configurably dimensioned for storage in one of the receptacles.

14. The carrying case according to claim 12, wherein at least one of the external half shells has a pocket formed on its outer half shell for storage of loose items.

15. The carrying case of claim 12, wherein the foldable pocket panel has a front panel that includes multiple storage pockets secured along a bottom and side edges of the front panel thereby forming multiple storage spaces.

16. The carrying case according to claim 15, wherein the multiple storage pockets comprise at least two storage pockets of an upper and lower storage pocket, the upper storage pocket is an open pocket and the lower storage pocket includes a fastener member.

17. The carrying case according to claim 12, wherein the front side of the foldable closure panel has a pair of elongated elastic straps secured at multiple points of the front face so as to form a plurality of loops for retaining articles of specified size and shape.

18. The carrying case according to claim 12, wherein the front pocket panel further includes multiple individuated lucky charm pockets for carrying amulets.

19. The carrying case of claim 12, wherein the multipocket assembly further includes a foldable flap panel with a fastener member that secures a back side of the foldable closure panel with the flap panel, thereby securing articles retained by the multipocket assembly when the closure panel is secured.

20. A bag comprising:

a first peripheral wall defining a first interior space;

a second peripheral wall defining a second interior space, wherein:

the second peripheral wall is rotationally coupled to the first peripheral wall; and the second peripheral wall is rotatable between a first position where the second peripheral wall closes a first end of the first peripheral wall, and a second position where the second peripheral wall is rotationally spaced away from the first end of the first peripheral wall;

a first panel disposed across the first interior space, thereby dividing the first interior space;

a multipocket assembly mounted to one of the peripheral walls and having:

a front pocket panel and a foldable closure pocket panel the front pocket panel including a pleated pocket panel section that forms a plurality of pockets, each pocket having an open top and shaped and configured to receive articles; and a foldable flap panel that has a fastener member that secures to a back side of the foldable closure pocket panel with the flap panel thereby securing articles retained by the multipocket assembly when the foldable closure panel is secured;

wherein the foldable closure pocket panel is configured to overlap and close the open top of the plurality of pockets for securing articles contained within.

21. The bag according to claim 20 further comprising a second panel rotationally coupled to the first peripheral wall, wherein the second panel is rotatable between a first position where the second panel closes a second end of the first peripheral wall, and a second position where the second panel is rotationally spaced away from the second end of the first peripheral wall.

22. The bag according to claim 21 further comprising a third panel disposed to close a first end of the second peripheral wall.

* * * * *